United States Patent [19]

Hvass

[11] 4,048,713

[45] Sept. 20, 1977

[54] METHOD OF MAKING COMPACT ELECTRIC COILS

[76] Inventor: Mogens Hvass, Damagerveg 5, Stilling 8660 Skanderborg, Denmark

[21] Appl. No.: 584,862

[22] Filed: June 9, 1975

[51] Int. Cl.[2] ..... H01F 41/04; H04R 31/00

[52] U.S. Cl. ..... 29/594; 29/605; 72/342; 72/364

[58] Field of Search ..... 29/605, 594, 447, 433; 72/342, 364; 336/223, 205; 140/1

[56] References Cited

U.S. PATENT DOCUMENTS

| | | | |
|---|---|---|---|
| 1,041,293 | 10/1912 | Keller | 29/605 |
| 3,050,613 | 8/1962 | Sheinhartz et al. | 29/447 |
| 3,298,096 | 1/1967 | Stuart | 72/342 |
| 3,348,183 | 10/1967 | Hodges et al. | 29/605 |
| 3,383,900 | 5/1968 | Hartesveldt | 72/342 |
| 3,541,682 | 11/1970 | Hildebrandt | 29/605 |
| 3,667,118 | 6/1972 | Camardella | 29/605 |
| 3,845,547 | 11/1974 | Reynolds | 29/423 |

*Primary Examiner*—Carl E. Hall
*Attorney, Agent, or Firm*—Craig & Antonelli

[57] ABSTRACT

A method of producing a compact electric coil such as a voice coil for loudspeakers, whereby a coil member is wound of ordinary round wire having a coating of a thermoplastic or thermosetting bonding material, whereafter the coil member mounted on a mandrel is heated together with the mandrel and thereafter cooled from its outside so as to crimp around the mandrel while this is still warm and expanded. Hereby the round wire will be forced inwardly with high force so as to get cross sectionally deformed to fill out the available space to a very large degree, and the bonding material sets so as to hold the coil in its compacted shape whereby a coil of high rigidity and heat conductivity is produced. The coil is easily retractable from the mandrel upon further cooling of the latter.

8 Claims, 9 Drawing Figures

Figure 4:
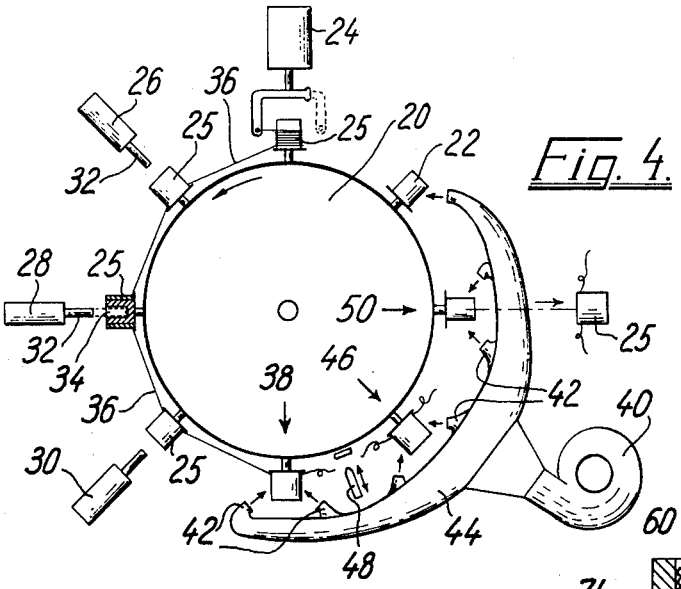

Fig. 1b.
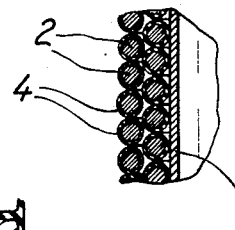
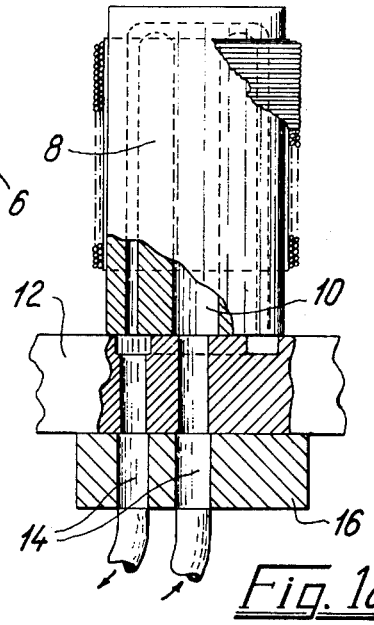
Fig. 1a.
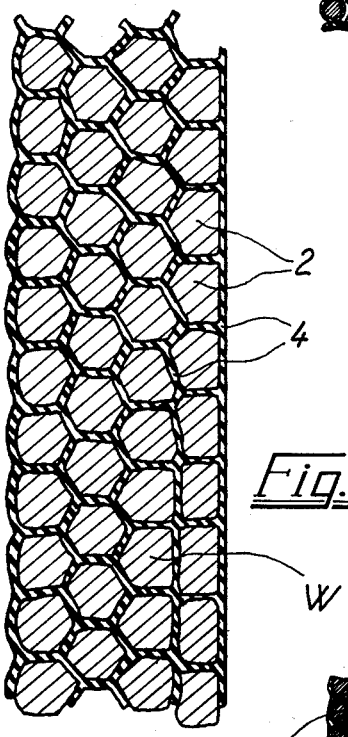
Fig. 3.
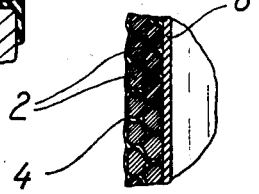
Fig. 2b.
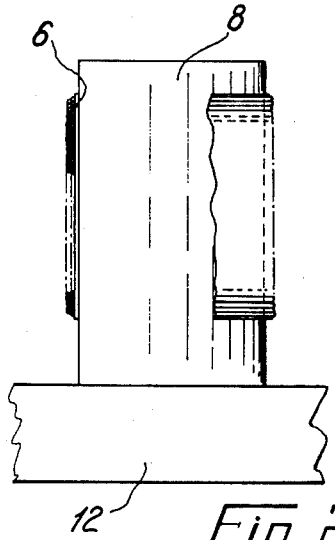
Fig. 2a.

METHOD OF MAKING COMPACT ELECTRIC COILS

The present invention relates to electric coils and more particularly to the production of compact coils in which the space occupied by the windings is filled out as far as possible with the winding material itself, e.g. coils in which the so-called space factor is high. Especially in voice coils for loud speakers it is important that the coil is as compact as possible, since the air gap in which the coil works should be as narrow as possible, but also in other coil devices such as transformers it may be generally desirable to use compact coils also because a good heat conductivity of the coil is desirable. An associated problem is that the windings should be bonded together by a suitable binding material such as a thermoplastics, and for making a compact coil, of course, it should be ensured that the desired high space factor is not counteracted by an unnecessary surplus of binding material between the windings. Usually the wire is coated with a thin layer of the binding material, and the ready wound coil is subjected to a heat treatment whereby the coatings of the juxtaposed wire portions float together so as to thereafter provide a firm bonding of the windings. An easy manner of providing the necessary heat is to connect the terminals of the coil with a current source so as to use the coil itself as a heater element.

A relatively good space factor is obtainable with the use of a thin bonding material coating and by winding the coil in such a manner that each wire portion is rested against two underlying wire portions and not on the top of one underlying wire portion. A still better space factor would be obtainable with the use of wire of rectangular or hexagonal cross section, but such a wire is more expensive than a round wire, and in automatic coil winding problems will occur due to twist tendencies of the wire, whereby the space factor would not at all be good.

The invention relates to a method of producing compact electric coils wound of insulated wire of round cross sectional shape, and it is the purpose of the invention to provide a method whereby an improved space factor is obtainable.

Accordng to the invention the coil, upon being wound, is maintained or mounted on a mandrel filling out the coil, whereafter the coil is subjected to a treatment involving radial compression of the winding layers until the wire in each winding becomes deformed by its surface portions at each place being pressed substantially flat against the surfaces of the adjoining wire portions of the adjacent windings. Hereby the windings will be deformed so as to engage each other in a very compact manner. The compression of the winding layers may be effected by a purely mechanical pressure, preferably applied with the coil in a heated condition, but according to the invention it is highly advantageous to effect the compression by means of a thermal treatment as described below.

The invention also comprises an apparatus for carrying out the method according to the invention, as defined in the appended claims.

In the following the invention is described in more detail with reference to the accompanying drawing, in which FIG.1 1*a* is a sectional view of a voice coil wound on a mandrel.

FIG. 1*b* is a partial sectional view of the coil shown in FIG. 1*a*.

Figure 5:
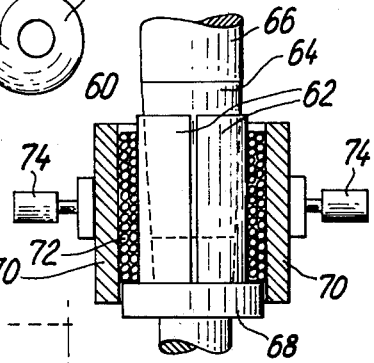
Figure 6:
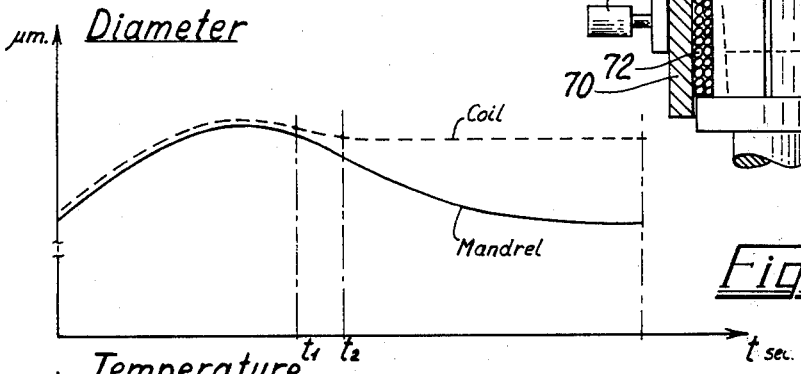
Figure 7:
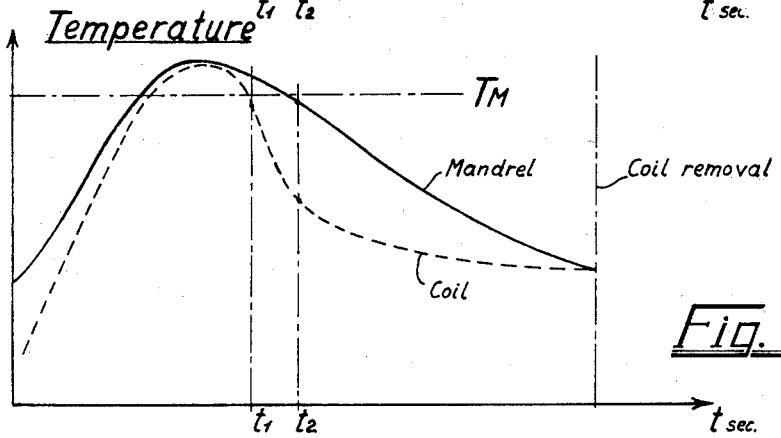

FIG. 2*a* is a corresponding view of the coil at a later stage of the production thereof, FIG. 2*b* is a partial sectional view of the coil shown in FIG. 2*a*, FIG. 3 is a detailed sectional view of the winding layers of another coil upon deformation thereof, FIG. 4 is a schematic view of a combined coil winding and forming apparatus, FIG. 5 is a plane view partly in section illustrating alternative mechanical deformation of the wires, FIG. 6 is a graphic illustration of the thermal treatment of the mandrel and the coil, and FIG. 7 is a similar illustration of the diameter variations of the mandrel and the coil, respectively, during the thermal treatment thereof.

For producing a compact coil according to the invention the coil is wound from ordinary round coil wire 2 coated by a layer 4 of a suitable insulating and binding material such as polyamid or polyamid-phenol. The coil is wound on a tubular body 6 of a thin sheet or foil material which is placed on a mandrel 8, and as well known the winding may be effected with the mandrel being stationary or rotary. The coil is wound with the wire somewhat prestretched and so as to have each wire portion in one wire layer rested against two wire portions of the adjoining layer.

As mentioned, in order to heat the coil for making the binding material 4 run together it is customary to simply connect the coil terminals to an electric current source whereby heat is rapidly generated in the coil windings. By this heating the windings will expand somewhat, but during the following cooling thereof they will not retract themselves against the mandrel because the binding or bonding material solidifies to bond the windings before the coil gets cold.

According to the invention, however, a different heating method is used, viz. consisting in supplying heat locally to the mandrel, from which the heat will be transferred to the coil windings. The heat may be supplied to the mandrel in any of a variety of manners, and it is shown by way of example only that the mandrel may be provided with internal channels 10 for receiving a heating medium from an external source.

When the mandrel is heated locally the first result will be a radial expansion of the mandrel itself, whereby the coil wire is generally stretched. Thereafter the heat is transferred to the windings so as to gradually soften the binding material 4 and cause the windings to expand thermally, thus also causing the stretch of the wire to be reduced. When the windings have been heated to the necessary degree for softening the binding material the supply of heat to the mandrel is stopped, whereafter the mandrel will still for some time remain hot and expanded.

The next and perhaps most important step of the method according to the invention is to cool the coil winding from the outside thereof while the mandrel is still expanded, preferably by a positive cooling, e.g., with a blast of cold air, gas or atomized liquid or by means of cooling claws brought into contact with the exterior coil surface. This cooling causes the coil winding to crimp, and since the mandrel is still expanded the crimping of the wire results in the building up of a considerable stretch in the wire and correspondingly a considerable inwardly directed pressing force of an outer winding layer against an inner winding layer and further against the surface of the mandrel through the sheet 6. The forces produced hereby are strong enough to cause the single wire portions to be pressure deformed by their engagement with the adjoining portions, and as illustrated in FIG. 2 the result is that the juxtapposed wire portions will get deformed into a honey comb cross sectional shape so as to be rested against each other in a practically plane surface-to-surface-relationship rather than a tangential engagement between round wires. This involves that an optimal space factor is obtained and that also the bonding between the juxtapposed wire surface portions becomes optimal. It should be mentioned that the wire is able to withstand a considerable stretching force due to the overall frictional engagement between the juxtapposed wire portions.

When thereafter also the mandrel is cooled the associated contraction thereof will make the coil structure easily releasable from the mandrel, since at that time the coil has already been stabilized in its deformed shape. If desired, for further reducing the maximum thickness of the coil winding the outer surface of the coil may be ground for removing any surplus of bonding material.

The honey comb structure will be still more expressed in a coil having three or more winding layers, as illustrated in FIG. 3 which shows a fraction of a four layer coil made according to the invention. Besides, this coil has been wound direct on the mandrel without the use of a tubular body 6.

The mandrel may be cooled naturally or by means of a cooling medium applied to the exterior or interior of the mandrel, and upon the removal of the coil therefrom the mandrel may receive a new coil member to be treated, with the mandrel used either as a winding mandrel or as a mandrel for receiving an already wound coil member.

Generally the important feature of the invention is the crimping of the coil windings against a mandrel or core member which in the heated condition of the coil fills out the space inside the coil and maintains its diameter while the crimping of the windings is going on. Thus, it is not essential, though highly advantageous that the mandrel should be subjected to a positive heating, since it could alternatively be mechanically expanded and contracted. The deformation caused by the cooling crimping of the coil is not primarily dependent of the coil previously having been heated to any particular temperature, but by the said preheating up to e.g. 300° C it is obtained that the bonding material 4 flows together and that the subsequent crimping deformation of the wire is facilitated. Due to the high crimping force, however, the wire would get deformed even without being particularly hot.

Principally the coil may be removed from the mandrel without the latter first being contracted, since the crimped coil could be reheated for expansion without the deformed wire cross section being redeformed into the original round shape. Moreover, the wire deformation principally could be effected mechanically by forcing clamp jaws against the coil or by expanding the mandrel with the coil supported inside a surrounding cylindric element, preferably while the coil is heated, or by treating the coil with a pressing roller moved along the interior or exterior side of the coil.

As mentioned the invention also comprises an apparatus for effecting the coil deformation according to the principles described hereinbefore. The apparatus may be combined with a winding machine so as to automatically receive on its mandrel or mandrels the coil members wound by the winding machine, or the apparatus may be integral with the winding machine, the expansion mandrels thereof being used additionally as winding mandrels, whether being of the stationary or the rotary type. The mandrels may be arranged in a row on a movable support such as a turn table, which is designated 12 in FIG. 1, and which moves the mandrels successively past a receiving station in which they receive the coil members either as wound onto the mandrels or supplied thereto from an independent winding machine, and further to a heating station in which the mandrels are heated e.g., by means of hot oil or air supplied to the interior channel system 10 through holes or slots 14 in a glider body 16 engaging the support 12. For the invention, however, it is entirely unimportant how the heating is effected, because also the coil is allowed to be heated, i.e., the heating could well be effected from the outside of the mandrel, e.g., by means of a high frequency heating technique.

Thereafter the support 12 is moved further to or past a coil cooling station in which suitable means are provided for cooling the coils from the outside thereof, e.g., simply by a blast of cold air or gas or atomized water whereby the said deformation of the coil wire will take place. The next station is a reject station in which the coils are removed from the mandrels upon these in the meantime having been cooled either by natural cooling or by means of a cooling medium supplied to the internal channel system 10 or in any other manner. From this latter station the mandrels are moved back to the initial receiving station. Alternatively the apparatus may be provided with means for a mechanically controlled expansion and contraction of the mandrels or with the above mentioned means for mechanically pressing the coil members.

It should be mentioned that coils wound of aluminum or soft copper wire are particularly well suited to be treated in the described manner and that the invention eliminates or reduces the normal problem of the coil thickness being locally increased at the crossing areas where the wire from one winding crosses the top of an underlying wire for passing to the next winding, this problem being due to the fact that the winding layers are wound with alternating pitch; at the said crossing areas the wire will be deformed into a flat shape by the crimping of the coil whereby the said local increase of the thickness will disappear. In FIG. 3 such a wire crossing is illustrated with the wire W as the central wire in the crossing area shown.

The invention is usable also for the production of coils of non-circular shape, but normally it should be preferred to first wind and treat a round coil which is pressed into its desired shape after having been crimped and removed from the mandrel.

The invention also comprises a coil produced by the described method so as to have an improved space factor. For some coils the space factor itself is not important, but it is very important that an associated advantage is a very firm bonding of the coil windings to each other and to the bobbin, if any, whereby a very rigid coil is obtained, and that the heat conductivety of the coil will be very good.

By way of example an apparatus according to the invention is schematically illustrated in FIG. 4. It comprises a turn table 20 having a number of radially protruding mandrels 22 and gear means (not shown) for turning the table stepwise, whereby the mandrels are successively brought to rest in the various stations of the apparatus. A first station is a winding station in which a well known winding device 24 operates to wind a coil 25 on the mandrel, the mandrel thereafter being moved stepwise through three positions constituting a heating station. In each of these positions is placed a heater unit 26, 28 and 30, respectively, each having a heated rod member 32 which is reciprocally arranged so as to be shiftable between an active position in which it projects into an outer cylindric cavity 34 of the mandrel 22 so as to heat the mandrel from the inside thereof, and a retracted, inoperative position in which it allows the turn table to be rotated. The elements 32 might as well represent the exhaust spouts of air heater units.

The coil winding device 24 leaves the wire uncut between the coils wound on the consecutive mandrels, so the wire, as shown at 36, will extend stretched between the consecutive coils in the said heating station, whereby there are not problems as to anchoring of loose wire ends of the coils. By the heating the mandrels 22 expand the transfer heat to the coils 25 whereby the coating on the coil wire is softened. In the next station, designated 38, the coil is subjected to a blast of cold air produced by a blower 40 and directed towards the outside of the coil by suitably arranged outlet openings 42 of an air duct system 44. Hereby the coil 25 or at least the outer surface thereof is almost immediately cooled down to below the softening or melting point of the bonding coating on the wire and the coil starts crimping while the mandrel is still hot. Also in the next position, designated 46 the coil is subjected to the cooling air whereby its crimping is completed against the mandrel which is still expanded though its temperature has decreased somewhat from its maximum. Between the positions 38 and 46 is provided a cutting device 48 which is actuable to cut the exposed wire portion 36 which is now bonded to the respective coils at the places where it leaves the coil.

Also in the following position, designated 50, the cooling blast is directed against the mandrel and the coil, and rejector means (not shown, but well known in the art) are provided for removing the coil from the mandrel. In the meantime the mandrel has cooled down sufficiently to contract itself to such a degree that the coil is readily releasable therefrom.

In the following position, designated 52, the mandrel is further cooled, if necessary, before it is moved further to the winding station. If applicable the tubular core 6 or a similar bobbin may be placed on the mandrel in the position 52 if not in the winding station itself.

As mentioned, the winding station may be substituted by a station in which ready wound coil members are mounted on the mandrels 22. Further, as mentioned, the means for effecting the pressing of the coils may be substituted partly or entirely by mechanical pressing means, an example of such an arrangement being shown in FIG. 5. An expansible mandrel 60 is made of two or more segments 62 having cylindric exterior surface portions and conical interior surface portions cooperating with a conical end portion 64 of a rod 66 which is operable, by control means not shown, to be forced into the interior space of the split mandrel 60 so as to cause the segments thereof to expand. The mandrel is rested on a base plate 68 and is introduceable into a cylindric member 70 together with a coil member 72 mounted on the mandrel. When the mandrel is expanded by means of the rod 66 the coil will be pressed between the mandrel and the inner side of the cylindric member 70, and thereafter, upon contraction of the mandrel, the coil is rejectable from the cylindric member by means of the base plate 68 being pushed through the cylindric member.

The cylindric member 70 may be segmented and have each of its segments operatively connected with means such as hydraulic cylinders 74 for moving the segments radially whereby a positive pressing force may be applied additionally or alternatively against the exterior side of the coil.

The mandrel 60 may be representative of the mechanically expansible mandrel which is mentioned hereinbefore in connection with the described cooling crimping of the coil member, and both the mandrel 60 and the segmented cylindric member 70 may be representative of the above mentioned mechanical cooling claw means for effecting the crimping cooling of the heated coil member.

Though the desired deformation of the coil wire is thus effectable by mechanical means the described thermally effected deformation will normally be highly preferable. The interrelated FIGS. 6 and 7 show the variation of the mandrel diameter (FIG. 6, solid line) and the coil diameter (FIG. 6, dotted line) as a function of the time during which the described heating and cooling is going on, until the coil is removed from the mandrel at the moment $t_R$, and FIG. 7 correspondingly shows the temperature variation of the mandrel (solid line) and the coil (dotted line). In FIG. 7 the temperature $T_M$ represents the melting point of the bonding material on the coil wire. This material starts to solidify when the coil temperature at the moment $t_1$, drops below $T_M$, and a short time thereafter, at the moment $t_2$, the material has set sufficiently to thereafter maintain the coil diameter substantially constant while the mandrel is still shrinking by the further cooling thereof. In view of the foregoing detailed description of the heating/cooling cycle, however, it is not deemed necessary to explain the curves of FIGS. 6 and 7 in more detail.

What is claimed is:

1. A method of producing compact electric coils having a high space factor, such as voice coils for loudspeakers, whereby the coil is wound in winding layers of insulated wire of round cross sectional shape, characterized in that the method comprises the steps of arranging a coil on a mandrel filling out the coil, subjecting the mandrel and coil to a differential thermal treatment to cause, without a counter pressure being exerted on the wire, a radial compression of the wire until the wire in each winding layer becomes deformed at surface portions thereof so as to be pressed substantially flat against the surfaces of the adjoining wire portions of the adjacent winding layers.

2. A method according to claim 1, characterized in that the step of subjecting the mandrel to a differential thermal treatment comprises: thermally causing said mandrel to expand, and cooling the coil with the mandrel still expanded.

3. A method according to claim 2, characterized in that the mandrel is heated to a temperature sufficient to soften the insulation coating of the wire, and in that the coil is cooled to a temperature sufficient for solidification of the insulation coating and for contraction without a corresponding contraction of the mandrel, the method further comprising cooling the mandrel subsequent to the cooling of the wire, and removing the coil from the mandrel.

4. A method of compacting an electric coil to increase the space factor thereof, the coil being comprised of a plurality of turns of round cross-sectional wires arranged in layers, the method comprising the steps of: arranging a coil on a mandrel filling out the coil, subjecting the mandrel and coil to a differential thermal treatment to effectively cause the coil windings to be tightened about the mandrel to such a degree that the resulting radial forces on the wire of the coil are sufficient to effect a cross-sectional deformation of the wire in each of the turns against adjacent turns and therewith compaction of the windings.

5. A method according to claim 4, characterized in that the step of subjecting the mandrel and coil to a differential thermal treatment includes heating the mandrel to cause a predetermined expansion thereof, cooling the coil with the mandrel still expanded, and contracting the mandrel for releasing the coil.

6. A method according to claim 5, characterized in that the step of contracting the mandrel includes directing a cooling medium at the mandrel.

7. A method according to claim 5, characterized in that the coil wire is insulated with a thermo-softenable insulation material, and in that the mandrel is heated to a temperature sufficient to soften the insulation matrial.

8. A method according to claim 7, characterized in that the step of heating the mandrel includes heating the mandrel from the inside thereof and allowing a transfer of heat from the mandrel to the coil, and wherein the step of cooling the coil includes supplying a cooling medium to the outside of the coil.

* * * * *